US010192670B2

(12) United States Patent
Nishi et al.

(10) Patent No.: US 10,192,670 B2
(45) Date of Patent: Jan. 29, 2019

(54) REACTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kouji Nishi, Mie (JP); Shinichiro Yamamoto, Mie (JP); Kazuhiro Inaba, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 15/553,024

(22) PCT Filed: Feb. 22, 2016

(86) PCT No.: PCT/JP2016/055106

§ 371 (c)(1),
(2) Date: Aug. 23, 2017

(87) PCT Pub. No.: WO2016/136680

PCT Pub. Date: Sep. 1, 2016

(65) Prior Publication Data

US 2018/0033536 A1 Feb. 1, 2018

(30) Foreign Application Priority Data

Feb. 27, 2015 (JP) ..... 2015-039355

(51) Int. Cl.
*H01F 27/08* (2006.01)
*H01F 27/255* (2006.01)
(Continued)

(52) U.S. Cl.
CPC ..... *H01F 27/255* (2013.01); *H01F 27/06* (2013.01); *H01F 27/08* (2013.01); *H01F 27/26* (2013.01);
(Continued)

(58) Field of Classification Search
CPC ..... H01F 27/00–27/36
(Continued)

(56) References Cited

U.S. PATENT DOCUMENTS

2009/0108971 A1 4/2009 Okamoto
2012/0326822 A1* 12/2012 Yokota ..... H01F 27/327 336/67
(Continued)

FOREIGN PATENT DOCUMENTS

JP H02-015307 B2 4/1990
JP 2004-241475 A 8/2004
(Continued)

OTHER PUBLICATIONS

Search Report for PCT/JP2016/055106, dated Apr. 26, 2016.

*Primary Examiner* — Tuyen Nguyen
(74) *Attorney, Agent, or Firm* — Honigman Miller Schwartz and Cohn LLP

(57) ABSTRACT

Provided is a reactor that can maintain the state of being fixed to an installation target, and whose magnetic core is difficult to damage. The reactor includes a combined body that includes: a coil; and a magnetic core that is located inside and outside the coil to form a closed magnetic circuit. An outer core portion of the magnetic core, the outer core portion, which is located outside the coil: is formed using a composite material that is a resin in which magnetic powder is dispersed; and is provided with bolt holes into which bolts for fixing the combined body to an installation target are inserted. The reactor further includes a flat plate member
(Continued)

that is fastened to the outer core portion by the bolts, and is disposed such that the coil is exposed.

2 Claims, 6 Drawing Sheets

(51) Int. Cl.
*H01F 27/06* (2006.01)
*H01F 27/26* (2006.01)
*H01F 37/00* (2006.01)
*H01F 27/28* (2006.01)

(52) U.S. Cl.
CPC ..... *H01F 27/2823* (2013.01); *H01F 37/00* (2013.01)

(58) Field of Classification Search
USPC .... 336/65, 83, 200, 210–212, 220–223, 232
See application file for complete search history.

(56) References Cited

U.S. PATENT DOCUMENTS

2014/0159844 A1* 6/2014 Suzuki ..... H01F 27/06
336/65
2016/0035475 A1* 2/2016 Maeno ..... H01F 27/263
336/208

FOREIGN PATENT DOCUMENTS

| | | | |
|---|---|---|---|
| JP | 2008-182075 | A | 8/2008 |
| JP | 2011-129593 | A | 6/2011 |
| JP | 5110710 | B2 | 10/2012 |
| JP | 3195212 | U | 12/2014 |
| JP | 2015-012146 | A | 1/2015 |

* cited by examiner

REACTOR

CROSS-REFERENCE TO RELATED APPLICATIONS

This application is the U.S. national stage of PCT/JP2016/055106 filed Feb. 22, 2016, which claims priority of Japanese Patent Application No. JP 2015-039355 filed Feb. 27, 2015.

TECHNICAL FIELD

The present invention relates to a reactor that is used as a constituent component of an on-board DC-DC converter that are mounted on a vehicle such as a hybrid vehicle and a power conversion. In particular, the present invention relates to a reactor that can maintain the state of being fixed to an installation target, and whose magnetic core is difficult to damage.

BACKGROUND

Reactors are a type of circuit component that performs voltage step-up and step-down operations. JP 2011-129593A discloses a reactor that includes: a coil that is formed by winding a winding wire; and a magnetic core that is located inside and outside the coil to form a closed magnetic circuit, and a coupling core portion (an outer core portion) of the magnetic core, which is located outside the coil, is formed using a mixture of magnetic material and resin. The outer core portion of the reactor includes an attachment portion that is provided with a through hole through which a bolt for fixing the reactor to the installation target is passed.

However, the reactor according to JP 2011-129593A tends to be inferior in terms of aspects such as strength and creep properties because the outer core portion is formed using a mixture that contains resin. Therefore, in the case where a bolt is passed through the through hole of the attachment portion (the outer core portion) and is fastened, there is the risk of damage such as a crack occurring in the outer core portion due to stress being concentrated at the portion to which the bolt is fastened when the bolt is fastened or a load such as vibration impact is applied while the reactor is operating. In particular, if the coil and the magnetic core generate heat due to energization and reach high temperatures while the reactor is operating, creep deformation is likely to occur and the fastening force of the bolt is likely to decrease. Therefore, if damage such as a crack occurs in the outer core portion, there is the risk of the reactor in the fixed state becoming loose.

The present invention is made in view of the above-described situation, and one objective of the present invention is to provide a reactor that can maintain the state of being fixed to the installation target, and whose magnetic core is difficult to damage.

SUMMARY

A reactor according to one aspect of the present invention includes a combined body that includes: a coil; and a magnetic core that is located inside and outside the coil to form a closed magnetic circuit. An outer core portion of the magnetic core, which is located outside the coil: is formed using a composite material that is a resin in which magnetic powder is dispersed; and is provided with bolt holes into which bolts for fixing the combined body to an installation target are inserted. The reactor further includes a flat plate member that is fastened to the outer core portion by the bolts, and is disposed such that the coil is exposed.

Advantageous Effects of Invention

The above-described reactor can maintain the state of being fixed to an installation target, and whose magnetic core is difficult to damage.

DETAILED DESCRIPTION OF PREFERRED EMBODIMENTS

Figure 1:
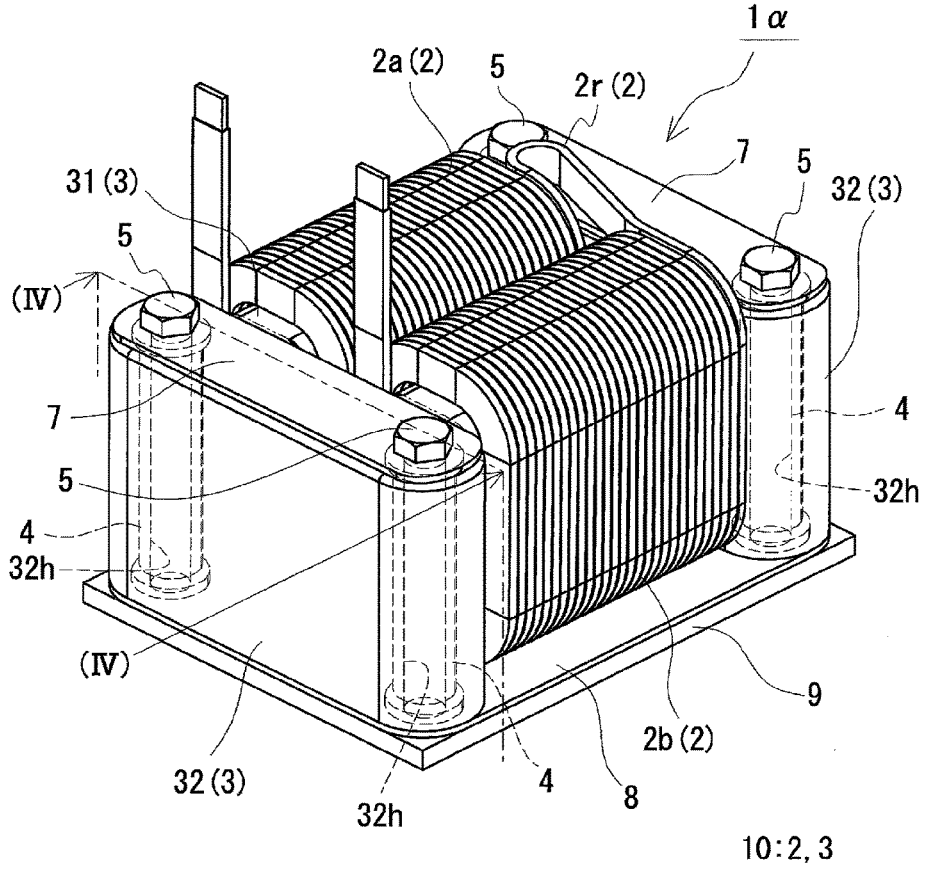
FIG. 1 is a schematic perspective view of a reactor according to a first embodiment.

Embodiments of the present invention will be listed and described.

(1) A reactor according to an embodiment of the present invention includes a combined body that includes: a coil; and a magnetic core that is located inside and outside the coil to form a closed magnetic circuit. An outer core portion of the magnetic core, the outer core portion, which is located outside the coil: is formed using a composite material that is a resin in which magnetic powder is dispersed; and is provided with bolt holes into which bolts for fixing the combined body to an installation target are inserted. The reactor further includes a flat plate member that is fastened to the outer core portion by the bolts, and is disposed such that the coil is exposed.

In the above-described reactor, when the bolts are inserted into the bolt holes of the outer core portion and fastened, the flat plate member receives stress that is caused by the fastening force of the bolts. Therefore, the stress that is caused by the above-described fastening force and is received by the outer core portion is reduced compared to when the flat plate member is not provided. Therefore, even if the outer core portion is formed using a mixture that contains resin, the maximum stress that the outer core portion receives is small, and even when the bolts are fastened or a load such as vibration impact is applied while the reactor is operating, damage such as a crack is difficult to form in the outer core portion. Due to the flat plate member being disposed such that the coil is exposed, better heat dissipation properties can be achieved compared to when the coil is covered by the flat plate member. Therefore, even if the coil and the magnetic core generate heat due to energization while the reactor is operating, the coil can dissipate heat as a heat dissipation path. Therefore, it is possible to suppress a rise in the temperature of the magnetic core, thereby preventing creep deformation from occurring in the magnetic core (the outer core portion). Therefore, it is possible to prevent the fastening force of the bolts from decreasing, and to maintain the reactor in the state of being fixed.

In the above-described reactor, the bolt holes, into which the bolts for fixing the combined body to the installation target are inserted, are formed in the outer core portion. Therefore, it is unnecessary to separately provide a fixing structure for fixing the combined body to the installation target, and it is possible to reduce the number of components. These bolt holes can be formed at the same time when the outer core portion is molded. Therefore, it is possible to achieve excellent productivity when manufacturing the reactor.

(2) In one example of the above-described reactor, the coil may include a pair of winding portions that are arranged side by side, the magnetic core may include: an inner core portion that is located inside the coil; and the outer core portion that is located outside the coil and is arranged in a direction that is orthogonal to an axial direction of the coil, and a center point of each of the bolt holes may be located outward of a circle that is formed around a center point that is located in the vicinity of a connecting portion between an inner surface of the inner core portion and an inner surface of the outer core portion, and have a radius that is equal to a thickness of the outer core portion in the axial direction of the coil.

Since the center point of each of the bolt holes is located outward of the above-described circle, each bolt hole is located at a distance from the main magnetic paths that are formed in the magnetic core when the coil is excited, and substantially does not have an influence on the magnetic paths.

(3) In one example of the above-described reactor, the flat plate member may be provided in a plurality, respectively for the bolt holes.

In the case of using a single flat plate member that has a plurality of through holes corresponding to the plurality of bolt holes formed in the outer core portion, it is necessary to align the plurality of through holes with the bolt holes at the same time. With the above-described configuration, flat plate members are respectively provided for the bolt holes in the outer core portion. Therefore, the task of aligning the through holes of the flat plate members with the bolt holes does not affect each other. Therefore, it is possible to easily and efficiently align the through holes of the flat plate members with the bolt holes of the outer core portion. Also, compared to the case where a flat plate member that spans the plurality of bolt holes, it is possible to reduce the amount of constituent material of the flat plate member, and to reduce the material costs.

(4) In one example of the above-described reactor, the outer core portion may include: a main body portion that includes a portion that serves as a magnetic path; and attachment portions that are formed integrally with the main body portion, and bulge from outer circumferential edges of portions of the main body portion in the vicinity of the installation target, and the bolt holes may be formed in the attachment portions.

Since the bolt holes are formed in the attachment portion, the bolt holes need not to be formed in areas that serve as magnetic paths, and do not affect the magnetic paths. The reactor is usually fixed to an installation target such as a cooling base. In other words, a point on the reactor that is closer to the installation target has a lower temperature. With the above-described configuration, the attachment portion in which the bolt holes are formed is located close to the installation target, and therefore portions of the outer core portion that receive the fastening force of the bolts have excellent heat dissipation properties and are likely to be kept at a low temperature, and creep deformation is unlikely to occur. Therefore, it is possible to further prevent the fastening force of the bolts from decreasing, and to more stably maintain the reactor in the state of being fixed.

The following describes the details of embodiments of the present invention. Note that the present invention is not limited to these examples, and is specified by the scope of claims. All changes that come within the meaning and range of equivalency of the claims are intended to be embraced therein. Elements having the same name are denoted by the same reference signs throughout the drawings.

First Embodiment

A reactor 1α according to a first embodiment will be described with reference to FIGS. 1 to 4.

Reactor

Overall Configuration

The reactor 1α according to the first embodiment includes a combined body 10 that includes: a coil 2 that includes winding portions 2*a* and 2*b* that are formed by spirally winding a winding wire; and a magnetic core 3 that is located inside and outside the winding portions 2*a* and 2*b* to form a closed magnetic circuit. The reactor 1α (the combined body 10) is installed to an installation target 9 such as a cooling base and is used. The magnetic core 3 includes: inner core portions 31 that are located inside the winding portions 2*a* and 2*b*; and outer core portions 32 that are located outside the winding portions 2*a* and 2*b*. The outer core portions 32 are formed using a composite material that is a resin in which magnetic powder is dispersed. The outer core portions 32 are provided with bolt holes 32*h* into which bolts 5 that fix the reactor 1α (the combined body 10) to the installation target 9 are inserted. One of the features of the reactor 1α according to the first embodiment 1 is that the reactor 1α is provided with flat plate members 7 that are interposed between the outer core portions 32 and the heads of the bolts 5, and are fastened to the outer core portions 32. The following describes each component in detail. In the following description, the installation target 9 side of the reactor 1α when the reactor 1α is installed to the installation target 9 is referred to as the lower side, and the opposite side is referred to as the upper side.

Coil

Figure 2:
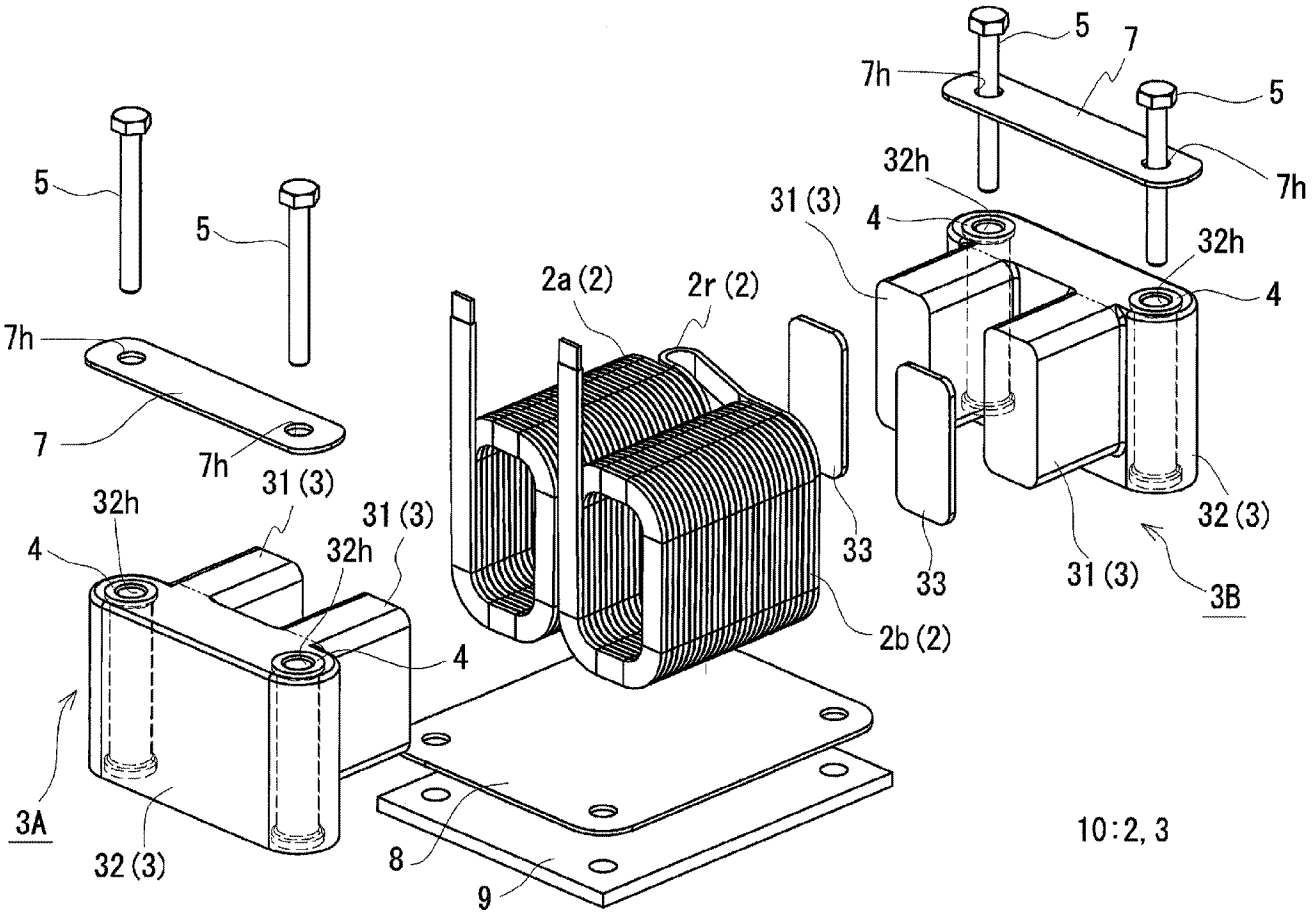
FIG. 2 is a schematic exploded perspective view of the reactor according to the first embodiment.

As shown in FIG. 2, the coil 2 includes: a pair of tubular winding portions 2*a* and 2*b* that are formed by spirally winding one continuous winding wire; and a coupling portion 2*r* that couples the winding portions 2*a* and 2*b* to each other. The winding portions 2*a* and 2*b* have a hollow tube shape by winding the winding wire the same number of times in the same winding direction, and are arranged side by side (in the horizontal direction) such that their axial directions are parallel with each other. The coupling portion 2*r* is a portion that is bent in a U-like shape to connect the winding portions 2*a* and 2*b*. The coil 2 may be formed by spirally winding one winding wire that does not have a joint portion, or by manufacturing the winding portions 2*a* and 2*b* using separate winding wires and joining the end portions of the winding wires of the winding portions 2*a* and 2*b* to each other through welding or crimping. Both end portions of the coil 2 are drawn out of the winding portions 2*a* and 2*b* in appropriate directions, and are connected to a terminal member, which is not shown. An external device such as a power supply for supplying power to the coil 2 is connected via the terminal member.

The winding portions 2*a* and 2*b* in the present embodiment have a rectangular tube shape. The winding portions 2*a* and 2*b* that have a rectangular tube shape are winding portions whose end surfaces have a rectangular shape (including a square shape) and whose corners are rounded. Of course, the winding portions 2*a* and 2*b* may have a circular tube shape. The winding portions that have a circular tube shape are winding portions whose end surfaces have a closed surface shape (such as an oval shape, a perfect circle shape, or a race track shape).

The coil 2 that includes the winding portions 2*a* and 2*b* can be formed on the outer circumferential surface of a conductor such as a flat wire or a round wire that is made of a conductive material such as copper, aluminum, magnesium, or an alloy thereof, using a coated wire that includes an insulative coating that is made of an insulative material. In the present embodiment, the winding portions 2*a* and 2*b* are formed through edgewise-winding of a coated flat wire that includes a conductor that is made of a copper flat wire and an insulative coating that is made of enamel (typically polyamide imide).

Magnetic Core

As shown in FIG. 2, the magnetic core 3 is formed by combining: a first divisional core 3A and a second divisional core 3B that each have a substantially U-like shape; and two gap members 33 that are interposed between the end surfaces of the divisional cores 3A and 3B. The first divisional core 3A and the second divisional core 3B are members that have the same shape, and the second divisional core 3B is the same as the first divisional core 3A rotated by 180°. Note that the divisional cores 3A and 3B do not necessarily have the same shape. The divisional cores 3A and 3B are arranged such that the gap members 33 are interposed between the leading ends of two protruding portions that branch off from the first divisional core 3A and the leading ends of two protruding portions that branch off from the second divisional core 3B. Thus, the magnetic core 3 is attached so as to have a ring-like shape, and forms a closed magnetic circuit when the coil 2 is excited.

As shown in FIGS. 1 and 2, the magnetic core 3 includes: the inner core portions 31 that are arranged inside the winding portions 2*a* and 2*b*; and the outer core portions 32 on which the coil 2 is substantially not present, and that are arranged so as to protrude to the outside of the winding portions 2*a* and 2*b*. In this example, the inner core portions 31 and portions of the outer core portions 32 are arranged in the axial direction of the winding portions 2*a* and 2*b*. For example, portions of the outer core portions 32 on the winding portions 2*a* and 2*b* side relative to the two-dot chain lines shown in FIGS. 1 and 2 protrude to the outside of the winding portions 2*a* and 2*b* relative to the end surfaces of the winding portions 2*a* and 2*b*. In the following description, portions that are arranged in the direction that is orthogonal to the axial direction of the winding portions 2*a* and 2*b* are referred to as the outer core portions 32.

Outer Core Portions

The outer core portions 32 have a shape that connects end portions of a pair of inner core portions 31. In this example, the outer core portions 32 have a columnar shape with upper and lower surfaces that have a race track shape. The lower surfaces of the outer core portions 32 are flush with the lower surfaces of the winding portions 2*a* and 2*b* of the coil 2. Therefore, the lower surfaces of the outer core portions 32 are in contact with the installation target 9 with a joining layer 8 being interposed therebetween. The joining layer 8 will be described later. Also, the lower surfaces of the outer core portions 32 are formed so as to protrude further downward compared to the lower surfaces of the inner core portions 31.

The outer core portions 32 are formed using a composite material that is a resin in which magnetic powder is dispersed, the resin serving as a binder.

A soft magnetic metal powder that includes pure iron, an iron-based alloy, an alloy containing a rare earth metal, or the like can be used as the magnetic material powder contained in the composite material. A coated powder in which the surfaces of magnetic particles are coated by an insulative coating can also be used as the magnetic material powder. In particular, the use of a coated powder effectively reduces loss that can be caused by eddy currents in the reactor. Examples of the insulative coating include a phosphoric acid compound, a silicon compound, a zirconium compound, an aluminum compound, and a boron compound.

The average particle size of the magnetic powder is no smaller than 1 μm and no greater than 1000 μm, preferably no smaller than 10 μm and no greater than 500 μm. The magnetic powder may be a mixture of several types of powders that have different particle sizes (a coarse powder and a fine powder) or a mixture of several types of powders that are made of different materials. Note that the magnetic powder in the composite material is substantially the same (kept the same) as the raw material powder. If a powder that has an average particle size that satisfies the above range is used as the raw material, the powder has high fluidity, and it is possible to manufacture the outer core portions 32 with high productivity using injection molding or the like.

Examples of the resin that can be used as the resin contained in the composite material include a thermosetting resin such as an epoxy resin, a phenol resin, a silicone resin, or a urethane resin, a thermoplastic resin such as a polyphenylene sulfide (PPS) resin, a polyimide resin, or a fluororesin, a room-temperature setting resin, and a low-temperature setting resin.

The amount of magnetic powder contained in the composite material that is used to form the outer core portions 32 may be no smaller than 20 vol % and no greater than 75 vol %, where the amount of composite material is assumed to be 100 vol %. Since the amount of magnetic powder contained in the composite material is greater than or equal to 20 vol %, the proportion of the magnetic component is sufficiently high, and it is easy to increase the saturation magnetic flux density. On the other hand, since the amount of magnetic powder contained in the composite material is smaller than or equal to 75 vol %, the mixture of magnetic powder and resin has high fluidity, and excellent productivity can be achieved when the outer core portions 32 are manufactured. The amount of magnetic powder contained in the composite material is preferably greater than or equal to 30 vol %, and particularly preferably greater than or equal to 40 vol %. The amount of magnetic powder contained in the composite material is more preferably smaller than or equal to 70 vol %, even more preferably smaller than or equal to 65 vol %, and particularly preferably smaller than or equal to 60 vol %.

In addition, the composite material may contain a powder (filler) that is made of a nonmagnetic material like a ceramic such as alumina or silica. This filler contributes to the improvement of the heat dissipation properties of the outer core portions 32 and the prevention of uneven distribution (to realize uniform distribution) of the magnetic powder contained in the composite material. The amount of filler contained in the composite material is preferably no smaller than 0.2 wt % and no greater than 20 wt %, where the amount of composite material is assumed to be 100 wt %.

For example, by changing the material and amount of magnetic powder contained in the above-described composite material, and by changing whether or not to add a filler, it is possible to easily adjust the magnetic properties of the outer core portions 32. In other words, the composite material makes it easier to manufacture the outer core portions 32 and the magnetic core 3 with desired magnetic properties. Also, since the composite material contains a resin, even when the material of the magnetic powder is the same as the material of the particles that is used to form the powder compact, the composite material tends to have low saturation magnetic flux density and low relative permeability. The saturation magnetic flux density of the composite material is preferably greater than or equal to 0.6 T, and more preferably greater than or equal to 1.0 T. The relative permeability of the composite material is preferably no smaller than 5 and no greater than 50, and more preferably no smaller than 10 and no greater than 35.

The outer core portions 32 that are formed using the above-described composite material can be typically manufactured using injection molding, transfer molding, MIM (Metal Injection Molding), or cast molding, for example. In the case of injection molding, it is possible to obtain the outer core portions 32 by filling the mixture of magnetic powder and resin into a molding die under a predetermined pressure to mold the mixture, and then solidifying the above-described resin. In the cases of transfer molding and MIM, the above-described mixture is filled into a molding die and is molded. In the case of cast molding, it is possible to obtain the outer core portions 32 by injecting the above-described mixture into a molding die without applying pressure, and molding and solidifying the mixture.

Figure 3:
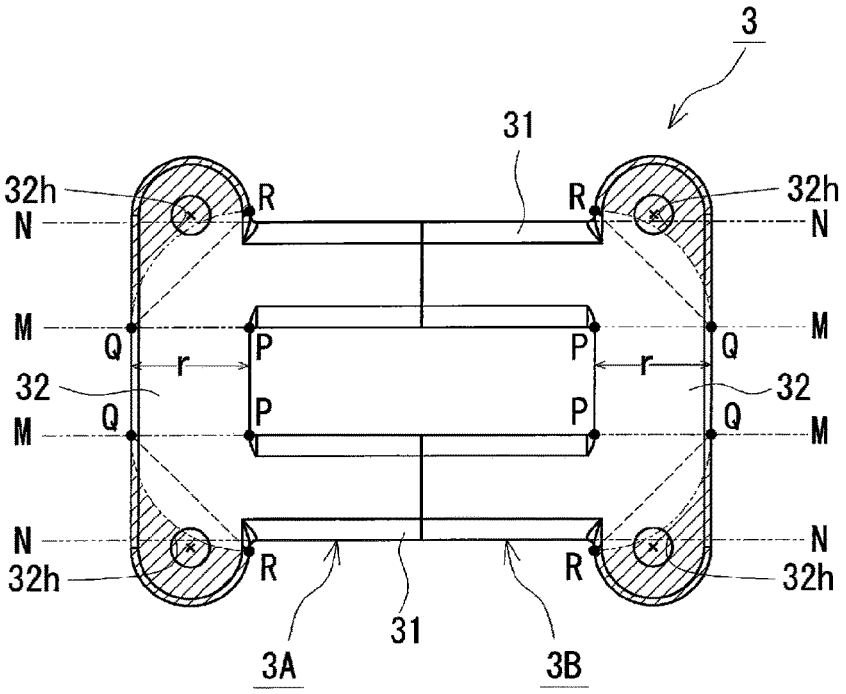
FIG. 3 is a top view of a magnetic core that is included in the reactor according to the first embodiment.

The outer core portions 32 are provided with the bolt holes 32*h* into which the bolts 5 that fix the reactor 1α (the combined body 10) to the installation target 9 are inserted. The bolt holes 32*h* are through holes that penetrate through the outer core portions 32 from the upper surfaces to the lower surfaces. The respective center points of the bolt holes 32*h* are located at positions that are at a distance from main magnetic paths that are formed on the magnetic core 3 when the coil 2 is excited. The positions that are at a distance from the main magnetic paths are, for example, as shown in FIG. 3, located in areas (with hatching) that are located outward of the circles that are respectively formed around center points P that are located in the vicinity of the connecting portions between the inner surfaces of the inner core portions 31 and the inner surfaces of the outer core portions 32, and have a radius that is equal to a thickness r (in the axial direction of the coil 2) of the outer core portions 32. In this example, the center points P are intersection points of lines M that extend along the inner surfaces of the inner core portions 31 (in the axial direction of the coil 2) and the inner surfaces of the outer core portions 32 (extending in a direction that is orthogonal to the axial direction of the coil 2). The positions that are at a distance from the main magnetic paths are located in the corner areas of the outer core portions 32. Since the center points of the bolt holes 32*h* are located within the above-described areas, it is conceivable that there will be substantially no influence on the magnetic paths.

Alternatively, as shown in FIG. 3, the positions at a distance from the main magnetic paths may be located in areas that are located outward of lines that each connect a point Q and a point R. The points Q are intersection points of the above-described circles and the outer surfaces of the outer core portions 32, and the points R are intersection points of the above-described circles and the inner surfaces of the outer core portions 32. This is based on the fact that magnetic paths are characterized in that they tend to take a route where the magnetic flux is shortest. Due to this characteristic of magnetic paths, if the center points of the bolt holes 32*h* are located within the areas that are outward of the lines respectively connecting the intersection points Q and the intersection points R, it is conceivable that there will be little influence on the magnetic paths.

In the present embodiment, each bolt hole 32*h* is constituted by a tubular member (collar) 4 that includes a tubular body that is made of a metal such as brass, stainless steel, or steel and a flange that has a ring-like shape and protrudes outward from both circumferential edges of the tubular body. The collars 4 are embedded in the outer core portions 32, and the outer surfaces of the collars 4 (the end surfaces of the flanges) are flush with the outer surfaces of the outer core portions 32 (see FIG. 4). The collars 4 receive a fastening force from the bolts 5, and prevent the composite materials that constitute the outer core portions 32 from being damaged. The bolt holes 32*h* that are defined by the collars 4 can be easily formed using the collar 4 as cores when the above-described outer core portions 32 are formed. Note that the collars 4 are not essential. If the collars 4 are not used, the bolt holes 32*h* can be formed by arranging, as cores, rod-like members that correspond to the bolt holes 32*h*, when the outer core portions 32 are formed.

Inner Core Portions

The inner core portions 31 have a shape that matches the inner shape of the winding portions 2*a* and 2*b*. In this example, the shape is substantially a rectangular parallelepiped shape. In the present embodiment, one inner core portion 31 is constituted by one of the protruding portions of the first divisional core 3A, one of the protruding portions of the second divisional core 3B, and a gap member 33 that is sandwiched between these protruding portions.

The inner core portions 31 are, as with the outer core portions 32, formed using a composite material that is a resin in which magnetic powder is dispersed, the resin serving as a binder. In the present embodiment, the inner core portions 31 and the outer core portions 32 are integrated into one piece that has a substantially U-like shape, and are therefore formed using the same material. If the inner core portions 31 are configured to be independent of the outer core portions 32 (separated by the two-dot chain lines shown in FIGS. 1 and 2), it is possible to employ a configuration in which the inner core portions 31 each include a powder compact that is formed by molding the above-described magnetic powder through compression molding, and a resin mold portion that is formed on the surface of the powder compact. As the resin that constitutes the resin mold portion, a PPS resin, a polytetrafluoroethylene (PTFE) resin, a liquid crystal polymer (LCP), a polyamide (PA) resin such as nylon 6 or nylon 66, and a thermoplastic resin such as a polybutylene terephthalate (PBT) resin or an acrylonitrile butadiene styrene (ABS) resin may be used, for example. In addition, it is also possible to use a thermosetting resin such as an unsaturated polyester resin, an epoxy resin, a urethane resin, or a silicone resin. It is also possible to improve the heat dissipation properties of the resin mold portion by adding a ceramic filler such as alumina or silica to these resins. If the inner core portions 31 and the outer core portions 32 are configured to be independent of each other, the first divisional core 3A and the second divisional core 3B can be formed by connecting the cores 31 and 32 through bonding or fitting.

The gap members 33 can be formed using a nonmagnetic material like a ceramic such as alumina, and a resin such as polypropylene. Alternatively, the gap members 33 may be formed using an adhesive that is used to bond the two protruding portions that branch off the divisional core 3A and the two protruding portions that branch off the divisional core 3B.

Flat Plate Member

The flat plate members 7 are members that reduce stress that is caused by the fastening force of the bolts 5 and applied to the composite materials, and are plate-like members that have through holes 7*h* through which the bolts 5 for fixing the reactor 1α (the combined body 10) to the installation target 9 are inserted. In the state where the through holes 7*h* of the flat plate members 7 and the bolt holes 32*h* of the outer core portions 32 are aligned, the bolts 5 are inserted into the through holes 7*h* and the bolt holes 32*h*, and consequently the flat plate members 7 are interposed between the outer core portions 32 and the heads of the bolts 5. In this example, the bolt holes 32*h* are defined by the collars 4, and therefore portions of the flat plate members 7 are inserted between the flanges of the collars 4 and the heads of the bolts 5 (see FIG. 4).

The flat plate members 7 can be formed by using various materials that have excellent mechanical strength. For example, as the constituent material of the flat plate members 7, it is possible to use a metal material such as aluminum or an alloy thereof, magnesium or an alloy thereof, copper or an alloy thereof, iron, or austenitic stainless steel. In particular, it is preferable that the constituent material is a nonmagnetic material such as austenitic stainless steel. Also, if the thermal conductivity of the constituent material is excellent, even if the outer core portions 32 generate heat while the reactor 1α is operating, it can be expected that the flat plate members 7 will dissipate heat as heat dissipation paths. In addition, it is also possible to use a resin that is sufficiently heat resistant to withstand the temperature of the reactor 1α during the operation, for example. Fluororesin such as PTFE may be used, for example. If the flat plate members 7 are formed using a resin, it is preferable to use a resin that has higher creep resistance properties than the resin of the composite material at the operation temperature of the reactor 1α, or a resin that is harder than the resin of the composite material at the operation temperature of the reactor 1α.

Figure 4:
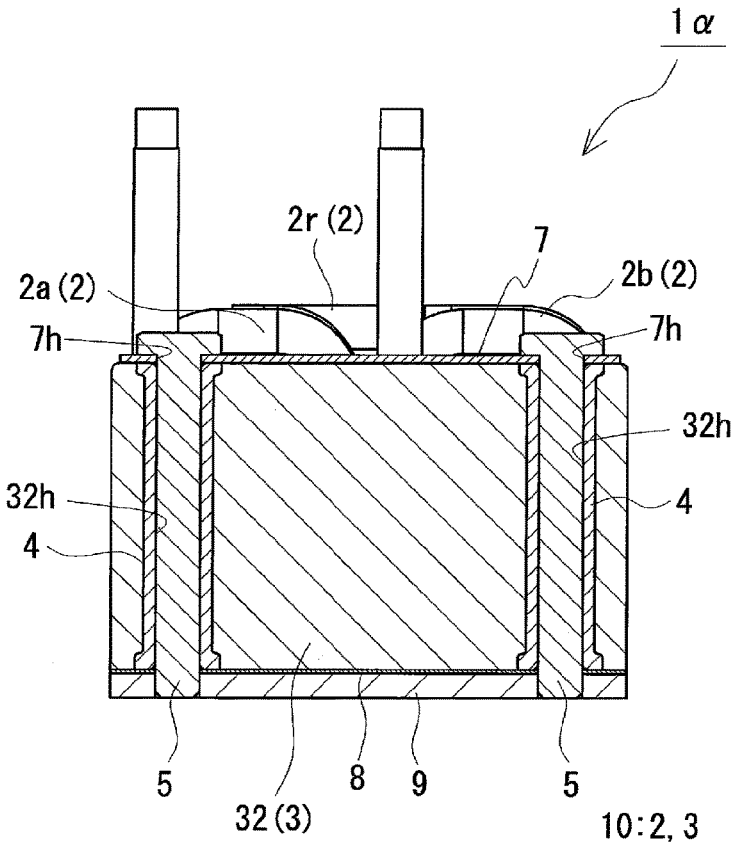
FIG. 4 is a cross-sectional view along (IV)-(IV) of the reactor shown in FIG. 1.

The flat plate members 7 have a size that is sufficient to protrude outward from the outer circumferential edges of the heads of the bolts 5 (see FIG. 4). With such a configuration, the heads of the bolts 5 are reliably brought into contact with the flat plate members 7, and the flat plate members 7 can reduce the stress that is caused by the fastening force of the bolts 5 and applied to the composite materials. As the above-described area of each of the flat plate members 7 that extend outward increases, the area of each of the flat plate members 7 that can receive the stress caused by the above-described fastening force increases, and the stress caused by the above-described fastening force and applied to the composite materials can be further reduced, and the maximum stress that the outer core portions 32 receive can be further reduced. The above-described area of each of the flat plate members 7 that extend outward is preferably greater than the area of the heads of the corresponding bolts 5 in plan view by 10% or more. If the flanges of the collars 4 of the bolt holes 32*h* are greater than the outer circumferential edges of the bolts 5, it is preferable that the flat plate members 7 have a size that is sufficient to protrude outward from the outer circumferential edges of the flanges.

In this example, each of the flat plate members 7 has substantially the same size as the upper surface of the corresponding outer core portion 32 (see FIGS. 1 and 4). Two through holes 7*h* are formed in each flat plate member 7. Specifically, each flat plate member 7 has a size that is sufficient to span the two bolt holes 32*h* formed in the corresponding outer core portion 32. In this way, if each flat plate member 7 is formed as one piece that has the through holes 7*h* corresponding to the plurality of bolt holes 32*h* that are formed in the corresponding outer core portions 32, the number of components is smaller than when there are a plurality of flat plate members 7 that correspond to the bolt holes 32*h* of each outer core portion 32. If the flat plate members 7 have a size that is sufficient to span the bolt holes 32*h* of the outer core portions 32, the collars 4 that define the bolt holes 32*h* of the outer core portions 32 are preferably embedded in the outer core portions 32 as described above. That is, if the end surfaces of the flanges of the collars 4 and the upper surfaces of the outer core portions 32 are flush with each other, the stress caused by the fastening force of the bolts 5 and applied to the composite materials can be distributed between the collars 4 and the upper surfaces of the outer core portions 32. Also, since the flat plate members 7 are in contact with the collars 4 and the upper surfaces of the outer core portions 32, it is easier to maintain the stably disposed state of the flat plate members 7 (see FIG. 4).

Regarding one of the outer core portions 32 on the side where the coupling portion 2*r* of the coil 2 is disposed, the flat plate member 7 is interposed between the lower surface of the coupling portion 2*r* and the upper surface of the outer core portion 32. In this case, it is preferable that at least a portion of the flat plate member 7 that faces the coupling portion 2*r* is provided with an insulative material. Specifically, it is preferable that the flat plate member 7 is formed using a metal of which the above-described portion that faces the coupling portion 2*r* is provided with an insulative coating of resin or the like, or is entirely formed using resin.

The flat plate members 7 are arranged such that the coil 2 is exposed. That is, the flat plate members 7 are located on the outer core portions 32 and do not extend toward the inner core portions 31 or the coil 2. Therefore, even if the coil 2 and the magnetic core 3 generate heat due to energization while the reactor 1α is operating, the coil 2 dissipates heat as a heat dissipation path. Therefore, it is possible to suppress a rise in the temperature of the magnetic core 3 (the outer core portions 32), and it is possible to prevent creep deformation from occurring in the outer core portions 32. In this example, the surface of the coil 2 is not covered by the flat plate members 7 or other members, and is exposed to the outside. However, the surface of the coil 2 may be covered by a member other than the flat plate members 7. This member preferably has excellent heat dissipation properties.

The thickness of the flat plate members 7 can be freely selected as long as the flat plate members 7 can reduce the stress that is caused by the fastening force of the bolts 5. The thickness of the flat plate members 7 is preferably no smaller than 0.2 mm and no greater than 3.0 mm, for example. If the thickness of the flat plate members 7 is within the above-described range, the flat plate members 7 are not unnecessarily thick, but can sufficiently reduce the stress caused by the above-described fastening force and applied to the composite materials.

It is preferable that the bolts 5 that are formed using a non-magnetic metal material such as austenitic stainless steel are used.

Joining Layer

As shown in FIGS. 1, 2, and 4, the reactor 1α shown in the present embodiment is provided with the joining layer 8 below the combined body 10. The joining layer 8 is interposed between the combined body 10 and the installation target 9. Due to the joining layer 8 being provided, the combined body 10 can be firmly fixed to the installation target 9. Thus, it is possible to restrict the coil 2 from moving, improve the heat dissipation properties, and stably fix the reactor 1α to the installation target 9. Preferably, the constituent material of the joining layer 8 is a material that includes an insulative resin, in particular, a ceramic filler or the like, and has excellent heat dissipation properties (e.g. a thermal conductivity of 0.1 W/m·K or more, even more preferably 1 W/m·K or more, and particularly preferably 2 W/m·K or more). Specific examples of the resin include thermosetting resins such as an epoxy resin, a silicone resin, and unsaturated polyester, and thermoplastic resins such as a PPS resin and LCP. It is easier to dispose the joining layer 8 if the joining layer 8 has a sheet-like shape.

Other Configurations

The above-described reactor 1α may include an adhesive sheet (not shown) that is disposed between the outer circumferential surfaces of the inner core portions 31 and the inner circumferential surfaces of the winding portions 2*a* and 2*b* to bond the inner core portions 31 and the winding portions 2*a* and 2*b* to each other. Since the adhesive sheet can fix the relative positions of the coil 2 and the magnetic core 3, it is possible to prevent the coil 2 and the magnetic core 3 from being displaced relative to each other due to vibrations or the like while the reactor 1α is operating.

The adhesive sheet may be formed using an insulative resin that is adhesive, which is, for example, a thermosetting resin such as an epoxy resin, a silicone resin, or unsaturated polyester, or a thermoplastic resin such as a PPS resin or LCP. It is possible to add the above-described ceramic filler to such an insulative resin to improve the thermal conductivity of the adhesive sheet. The adhesive sheet may also be formed using a foamed resin. If the adhesive sheet is formed using a foamed resin, after attaching an unfoamed adhesive sheet to the protruding portions (the inner core portions 31) of the first divisional core 3A and the second divisional core 3B, it is easier to insert the protruding portions of the divisional cores 3A and 3B into the winding portions 2*a* and 2*b*. After inserting the protruding portions into the winding portions 2*a* and 2*b*, it is possible to fix the coil 2 and the magnetic core 3 by foaming the unfoamed resin.

Effects

In the above-described reactor 1α, the flat plate members 7 are interposed between the outer core portions 32 (the flanges of the collars 4) and the heads of the bolts 5, and the flat plate members 7 can reduce the stress caused by the fastening force of the bolts 5 and applied to the composite materials. Therefore, even when the bolts 5 are fastened or a load such as vibration impact is applied while the reactor 1α is operating, the stress caused by the above-described fastening force and applied to the outer core portions 32 is small. Consequently, even if the outer core portions 32 are formed using a mixture that includes resin, it is possible to prevent damage such as a crack from occurring in the vicinity of the bolt holes 32*h* of the outer core portions 32. Since the flat plate members 7 are disposed such that the coil 2 is exposed, even if the coil 2 and the magnetic core 3 generate heat due to energization while the reactor 1α is operating, the coil 2 dissipates heat as a heat dissipation path. Therefore, it is possible to suppress a rise in the temperature of the magnetic core 3 (the outer core portions 32), and it is possible to prevent creep deformation from occurring. Therefore, it is possible to prevent the fastening force of the bolts 5 from decreasing, and to maintain the state in which the reactor 1α is fixed.

First Modification

A flat plate member may be disposed spanning the outer core portions. For example, if surfaces (e.g. the upper surfaces) of the combined body on the side where a flat plate member is to be disposed is substantially flush with each other (the upper surface of the coil and the upper surfaces of the outer core portions are flush with each other), a single flat plate member may be disposed over the outer core portions. That is, a flat plate member may be disposed along the axial direction of the coil. However, the flat plate member needs to be disposed such that the coil has exposed portions that are exposed from the flat plate member in the axial direction of the coil. Such a flat plate member may have an I-like shape (H-like shape) that includes: outer core portions that have substantially the same size as the upper surfaces of the outer core portions; and a connecting portion that has a rectangular shape, connects the two outer core portions, and are located between the winding portions of the coil. By using a single flat plate member that is disposed spanning the outer core portions, it is possible to reduce the number of components compared to when two flat plate members corresponding to the flat plate members are used.

Second Embodiment

Figure 5:
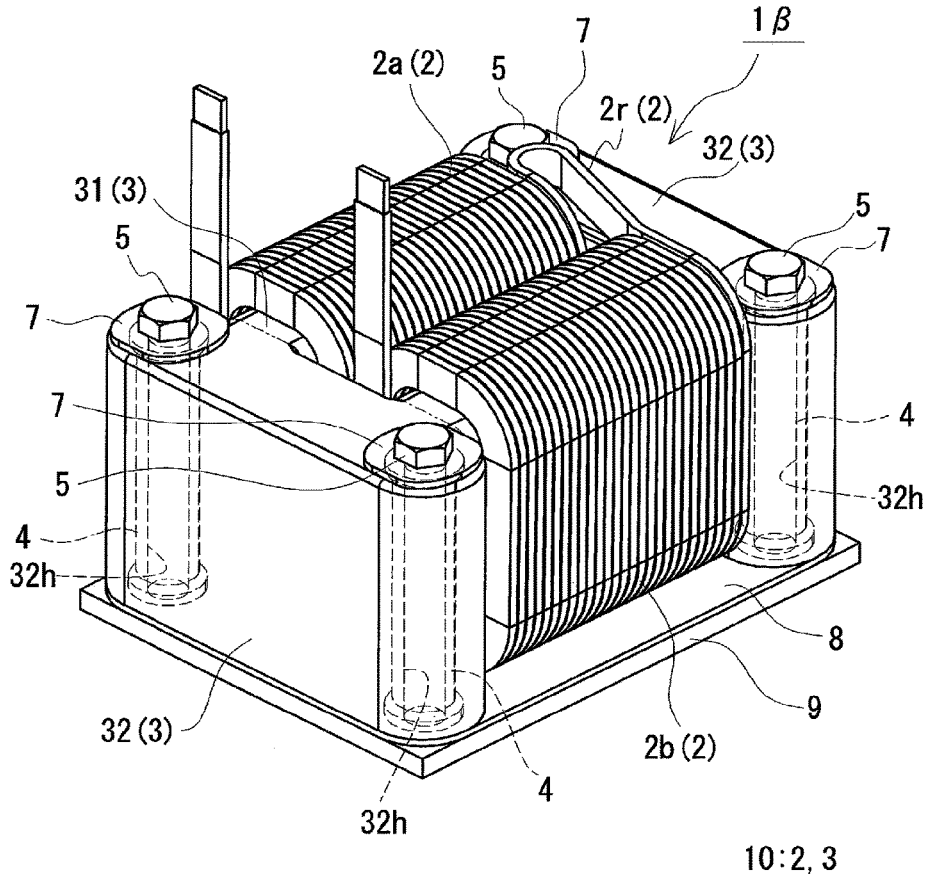
FIG. 5 is a schematic perspective view of a reactor according to a second embodiment.

In the second embodiment, as shown in FIG. 5, a reactor 113 in which the flat plate members 7 are respectively provided for the bolt holes 32*h* of the outer core portions 32 will be described. The second embodiment is different from the first embodiment only in that the flat plate members 7 are respectively provided for the bolt holes 32*h*, and other configurations are the same as those of the first embodiment. The flat plate members 7 in this example are shorter than those in the first embodiment and have a race track shape. If a single flat plate member 7 that has a plurality of through holes 7*h* corresponding to the plurality of bolt holes 32*h* formed in the outer core portions 32 is used, it is necessary to align the plurality of through holes 7*h* with the bolt holes 32*h* at the same time. Since the flat plate members 7 are respectively provided for the bolt holes 32*h* of the outer core portions 32, the flat plate members 7 are respectively provided corresponding to the bolt holes 32*h* of the outer core portions 32, and the alignment of the through holes 7*h* of the two flat plate members 7 with the bolt holes 32*h* do not affect each other. Therefore, it is possible to easily and efficiently align the through holes 7*h* of the flat plate members 7 with the bolt holes 32*h* of the outer core portions 32. Also, compared to the case where a flat plate member that spans the plurality of bolt holes 32*h*, it is possible to reduce the amount of constituent material of the flat plate member, and to reduce the material costs.

Third Embodiment

Figure 6:
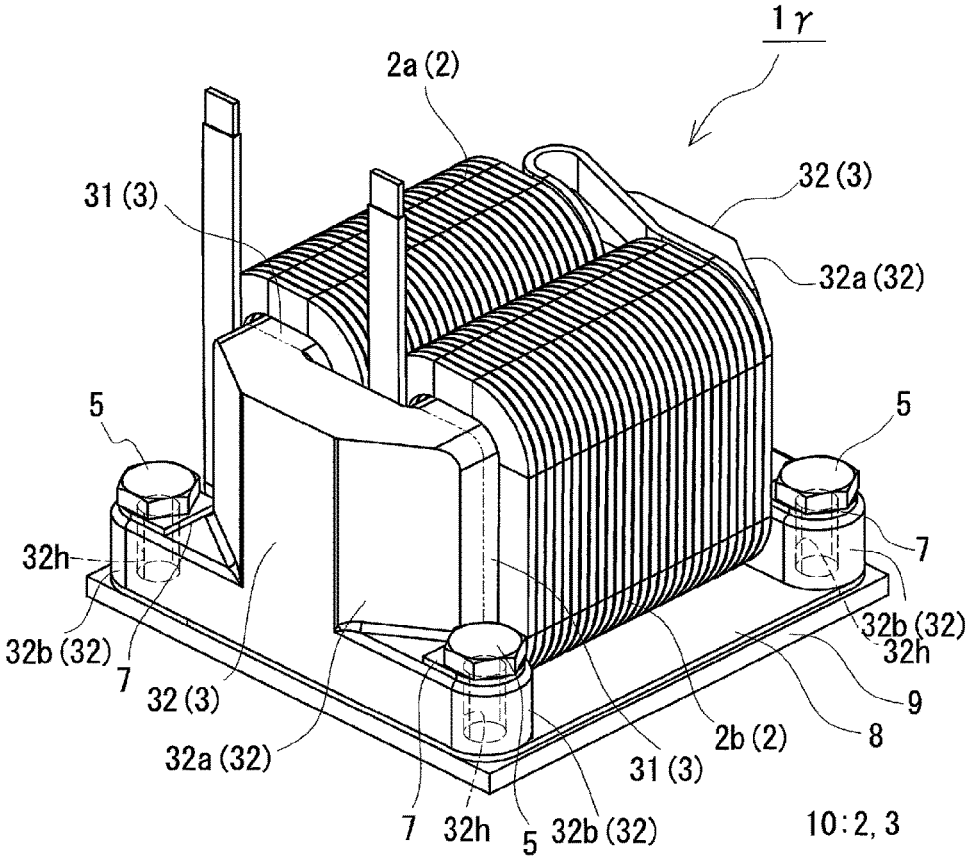
FIG. 6 is a schematic perspective view of a reactor according to a third embodiment.

In the third embodiment, as shown in FIG. 6, a reactor 1γ in which each outer core portion 32 includes: a main body portion 32*a* that serves as a magnetic path: and attachment portions 32*b* that are integrated with the main body portion 32*a* and bulge from the outer circumferential edges of portions of the main body portions 32*a* in the vicinity of the installation target 9 will be described. One of the features of the reactor 1γ in the third embodiment is that the bolt holes 32*h* into which the bolts 5 that fix the reactor 1γ to the installation target 9 are formed in the attachment portions 32*b*, and collars are not used for the bolt holes 32*h*. Other configurations are the same as those in the first embodiment. The following describes the components of the reactor 1γ, mainly focusing on components that are different from those of the first embodiment.

The main body portions 32*a* include portions that serve as main magnetic paths that are formed in the magnetic core 3 when the coil 2 is excited. These main magnetic paths are, as described in the first embodiment, areas inside the circles that are respectively formed around center points P and have a radius that is equal to a thickness r of the outer core portions 32, where the center points P are intersection points of lines M that extend along the inner surfaces of the inner core portions 31 and the inner surfaces of the outer core portions 32 (see FIG. 3). In this example, each main body portion 32*a* has a columnar shape with an upper surface and a lower surface that have a substantially trapezoidal shape, and includes a portion that is at a distance from the main magnetic path, in the vicinity of end portions of the main body portion 32*a* in the width direction (the direction that is orthogonal to the axial direction of the coil 2). A central portion of each outer core portion 32 in the direction in which the winding portions 2*a* and 2*b* are arranged protrude further than the other portion.

The attachment portions 32*b* are portions for fixing the reactor 1γ (the combined body 10) to the installation target 9. In the present embodiment, the attachment portions 32*b* are protruding pieces that bulge outward from the main body portions 32*a* below the main body portions 32*a*. The bolt holes 32*h* into which the bolts 5 that fix the reactor 1γ to the installation target 9 are formed in the attachment portions 32*b*. Since the attachment portions 32*b* are formed below the main body portions 32*a*, the attachment portions 32*b* are located close to the installation target 9 (a cooling base), and are prevented from being entirely heated to high temperatures. Therefore, creep deformation is unlikely to occur in the attachment portions 32*b*, and the attachment portions 32*b* are likely to prevent the bolts 5 from having a reduced fastening force. Therefore, it is possible to prevent the composite materials of the outer core portions 32 from being damaged despite the collars that are used for the bolt holes 32*h* in the first embodiment not being used. Since the collars are not used, it is possible to reduce the number of components, and it is possible to omit the process of embedding the collars in the outer core portions 32. Therefore, it is possible to achieve excellent productivity.

In this example, each flat plate member 7 has a half race track shape in which only one end side of the rectangle has a semicircular shape. Such flat plate members 7 are arranged corresponding to the bolt holes 32*h* formed in the attachment portions 32*b*, and thus the flat plate members 7 can reduce stress that is caused by the fastening force of the bolts 5 and applied to the composite materials. In addition to preventing the fastening force of the bolts 5 from decreasing as described above, the flat plate members 7 can prevent damage such as a crack from occurring in the vicinity of the bolt holes 32*h* of the outer core portions 32, and therefore it is possible to more stably maintain the state in which the reactor 1γ is fixed.

Second Modification

In the descriptions of the first to third embodiments above, flat plate members that have a size with which the flat plate members are located slightly inward of the contours of the outer core portions in plan view are used. If the flat plate members have a size corresponding to the above-described shape of the contours, the outer circumferential edges of the flat plate members are located above the chamfered corners of the outer core portions, and therefore the corners of the outer core portions are prevented from being damaged.

INDUSTRIAL APPLICABILITY

The reactor according to the present invention can be used in a preferable manner in various converters such as an on-board converter (typically a DC-DC converter) that is mounted on vehicles such as a hybrid vehicle, a plug-in hybrid vehicle, an electric vehicle, and a fuel cell vehicle, and a converter for an air conditioner, and in constituent components of a power converter device.

The invention claimed is:

1. A reactor comprising:

a combined body that includes: a coil; and a magnetic core that is located inside and outside the coil to form a closed magnetic circuit, wherein the coil includes a pair of winding portions that are arranged side by side, the magnetic core includes: an inner core portion that is located inside the coil; and an outer core portion that is located outside the coil and is arranged in a direction that is orthogonal to an axial direction of the coil, the outer core portion:

is formed using a composite material that is a resin in which magnetic powder is dispersed; and includes: a main body portion that includes a portion that serves as a magnetic path; and attachment portions that are formed integrally with the main body portion, are provided with bolt holes into which bolts for fixing the combined body to a cooling base are inserted, and bulge from outer circumferential edges of portions of the main body portion in the vicinity of the cooling base, a center point of each of the bolt holes is located outward of a circle that is formed around a center point that is located in the vicinity of a connecting portion between an inner surface of the inner core portion and an inner surface of the outer core portion, and has a radius that is equal to a thickness of the outer core portion in the axial direction of the coil, no collar is provided in any of the bolt holes, the reactor further comprises a flat plate member that is fastened to the outer core portion by the bolts, and is disposed such that the coil is exposed, and the bolts and the flat plate member are formed using a non-magnetic metal material.

2. The reactor according to claim 1, wherein the flat plate member is provided in a plurality, respectively for the bolt holes.

* * * * *